US005448883A

United States Patent [19]

Meserole, Jr. et al.

[11] Patent Number: 5,448,883

[45] Date of Patent: Sep. 12, 1995

[54] ION THRUSTER WITH ION OPTICS HAVING CARBON-CARBON COMPOSITE ELEMENTS

[75] Inventors: Jere S. Meserole, Jr., Issaquah; Daniel E. Hedges; Michael E. Rorabaugh, both of Seattle, all of Wash.

[73] Assignee: The Boeing Company, Seattle, Wash.

[21] Appl. No.: 23,285

[22] Filed: Feb. 26, 1993

[51] Int. Cl.[6] ..... F03H 1/00

[52] U.S. Cl. ..... 60/202; 313/299; 313/348; 313/360.1

[58] Field of Search ..... 60/202, 203.1; 313/293, 313/299, 334, 348, 352, 359.1, 360.1, 361.1

[56] References Cited

U.S. PATENT DOCUMENTS

| | | | |
|---|---|---|---|
| 2,926,251 | 2/1960 | Luce et al. | 250/41.9 |
| 3,632,460 | 1/1972 | Palfreyman et al. | 156/175 |
| 4,104,875 | 8/1978 | Birner et al. | 60/202 |
| 4,137,477 | 1/1979 | Krol et al. | 313/348 |
| 4,229,674 | 10/1980 | Hoet | 313/348 |
| 4,469,984 | 9/1984 | Sergeev et al. | 313/348 |
| 4,825,646 | 5/1989 | Challoner et al. | 60/202 |
| 5,225,296 | 7/1993 | Ohsawa et al. | 429/218 |

OTHER PUBLICATIONS

Brophy, J. R. et al., "Ion Engine Endurance Testing At High Background Pressures", AIAA/SAE/ASME/ASEE 28th Joint Propulsion Conference and Exhibit, Jul. 6-8, 1992, Nashville, Tenn., AIAA-92-3205 (20 pp.).

Garner, C. E. et al., "Fabrication and Testing of Carbon-Carbon Grids for Ion Optics", AIAA/SAE/ASME/ASEE, 28th Joint Propulsion Conference and Exhibit, Jul. 6-8, 1992, Nashville, Tenn., AIAA92-3149 (12 pp.).

Hedges, D. E. and J. S. Meserole, "Demonstration and Evaluation of Carbon-Carbon Ion Optics," (8 pp.).

*Primary Examiner*—Louis J. Casaregola

*Attorney, Agent, or Firm*—Christensen, O'Connor, Johnson & Kindness

[57] ABSTRACT

Carbon-carbon elements for ion optics sets are thermomechanically stable under the extreme temperature changes that are experienced in ion thrusters. The elements described include screen and accelerator grids and methods of producing such grids. The described elements are thermomechanically stable, lightweight, and resistant to sputtering.

32 Claims, 12 Drawing Sheets

ION THRUSTER WITH ION OPTICS HAVING CARBON-CARBON COMPOSITE ELEMENTS

FIELD OF THE INVENTION

The present invention relates to an ion optics set for an ion beam source, particularly ion beam sources for space propulsion, such as ion thrusters.

BACKGROUND OF THE INVENTION

Space propulsion, surface cleaning, ion implantation, and high energy accelerators use ion beam sources. These beam sources typically use two or three closely spaced multiple-aperture electrodes to extract ions from a source and eject them in a collimated beam. These electrodes are called "grids" because they have a large number of small holes. Typically, tile grids are made from molybdenum. A series of grids constitute an electrostatic ion accelerator and focusing system commonly referred to as the "ion optics."

Ion beam sources designed for spacecraft propulsion, that is, ion thrusters, should have long lifetimes (10,000 hours or more), be efficient, and be lightweight. These factors can be important in other applications as well, but they are not as critical to successful use as they are for ion thrusters. Ion thrusters have been successfully tested in space, and show promise for significant savings in propellant because of their high specific impulse (an order of magnitude higher than that of chemical rocket engines). They have yet to achieve any significant space use, however, due in part to lifetime limitations imposed by grid erosion and to performance constraints imposed by thermal-mechanical design considerations resulting from the use of metallic grids.

A typical configuration of an ion thruster is known as an electron bombardment ion thruster. In an electron bombardment ion thruster, electrons produced by a cathode strike neutral gas atoms introduced through a propellant feed line. The electrons ionize the gas propellant and produce a diffuse plasma. In other types of ion thrusters, known as "radio frequency ion thrusters," the propellant is ionized electromagnetically by an external coil, and there is no cathode. In both cases, an anode associated with the plasma raises its positive potential. To maintain the positive potential of the anode, a power supply pumps some of the electrons that the anode collects from the plasma down to ground potential. These electrons are ejected into space by a neutralizer to neutralize the ion beam. Magnets act to inhibit electrons and ions from leaving the plasma Ions drift toward the ion optics, and enter the holes in a screen grid. A voltage difference between the screen grid and an accelerator grid accelerates the ions, thereby creating thrust. The screen grid is at the plasma potential, and the accelerator grid is held at a negative potential to prevent downstream electrons from entering the thruster. Optionally, the optics can include a decelerator grid located slightly downstream of the accelerator grid and held at ground potential or at a lesser negative potential than the accelerator grid to improve beam focusing and reduce ion impingement on the negative accelerator grid.

A primary life limiting mechanism in ion thrusters is erosion of the ion optics (i.e., the grids) from ions impacting the grid material and sputtering it away. In ion thrusters, slow moving ions are produced within and downstream of the ion optics by a charge exchange (i.e., electron hopping) from neutral propellant atoms to fast moving ions that pass close by. These "charge exchange" ions are attracted to the accelerator grid and strike it at high energy, gradually eroding it away. The screen grid also experiences some erosion, mostly on the upstream side. This erosion of both the screen grid and accelerator grid eventually produces additional holes in the grids, causing them to cease functioning properly. Grid erosion is the primary life-limiting mechanism for ion optics.

A principal factor affecting both the efficiency and the weight of ion thrusters is how closely and precisely the grids can be positioned while maintaining relative uniformity in the grid-to-grid spacing under conditions conducive to significant thermal distortion. In the past, this factor has limited the maximum practical diameter of ion thrusters, which severely constrains taking advantage of scale effects that theoretically would improve efficiency, thrust-to-weight ratio, and reliability.

Molybdenum ion thruster grids are precisely hydroformed into matching convex shapes. The apertures are chemically etched. The convex shapes provide a predictable direction for the deformation that occurs due to thermal expansion when a thruster heats in operation. Changes in the actual spacing and the uniformity of spacing over the grid surfaces between the molybdenum grids is unpredictable and uncontrollable. The thermal expansion distribution is complex.

The changes in spacing that occur adversely effect performance. Although techniques have been developed to compensate for such changes, the unpredictable and nonuniform nature of the changes prevents complete compensation.

In ion beam sources used for terrestrial applications, today's grids are sometimes made of graphite, which expands much less than molybdenum when heated. Graphite is, however, relatively flexible and fragile and is not suitable for beam sources larger than about 15–20 cm in diameter, or for ion thruster grids, which are subject to severe vibration during launch from Earth.

It is desirable to have a screen grid and accelerator grid that have lifetimes of 10,000 to 20,000 hours for use in a variety of space propulsion applications. Such grids should also have an increased efficiency and should be lightweight for space applications. Additionally, the screen grids should allow for the construction of an ion optics set wherein the magnitude and uniformity of the spacing between the grids can be precisely predicted and maintained over the temperature range and pattern of differential surface heating the grids experience in use.

SUMMARY OF THE INVENTION

The present invention relates to an ion thruster having improved performance arising from using screen grids and accelerator grids made of carbon-carbon composite material. Carbon-carbon grids are lightweight and resistant to erosion. Carbon-carbon composite material can be fabricated such that its coefficient of thermal expansion is essentially zero. Heat effects on the carbon-carbon grids, therefore, are negligible. The grids maintain their relative spacing across the range of operating temperatures. They maintain their shape against differential surface temperatures. The gradient across the grids has no significant affect. In another aspect, the present invention relates to a process for producing grids made of carbon-carbon composite material.

In one aspect, the present invention is a grid element in an ion optics set for use in an ion beam source. The grid element includes a body having a plurality of apertures. The body is a carbon-carbon composite comprising carbon fibers embedded in a carbon matrix. This grid element can either be a screen grid, accelerator grid, or a decelerator grid.

In another aspect, the present invention is a process for manufacturing a carbon-carbon composite grid element for an ion beam source. The process includes the steps of positioning a plurality of carbon fibers in a crossed or woven array. This array of carbon fibers is then embedded in a carbon matrix. Apertures can be provided in the array during the positioning of the fibers, or the apertures may be cut after the fibers are embedded in the matrix.

In yet another aspect, the present invention is an ion optics set that includes a screen grid and an accelerator grid that each include a plurality of apertures and a body comprised of a composite of carbon fibers and a carbon matrix. Due to the virtually nonexistent thermal expansion of the grids formed in accordance with the present invention, the ion optics set can include a narrow gap which will remain substantially constant during operation.

It is important that the apertures between grids be precisely aligned and that they remain aligned. Otherwise, accelerated ions are directed into the next grid or are ejected at an angle to the desired axial direction. Carbon-carbon grids maintain this precise alignment of holes from grid to grid.

BRIEF DESCRIPTION OF THE DRAWINGS

The foregoing aspects and many of the attendant advantages of this invention will be better understood by reference to the following detailed description, when taken in conjunction with the accompanying drawings.

DETAILED DESCRIPTION OF THE PREFERRED EMBODIMENT

Figure 1:
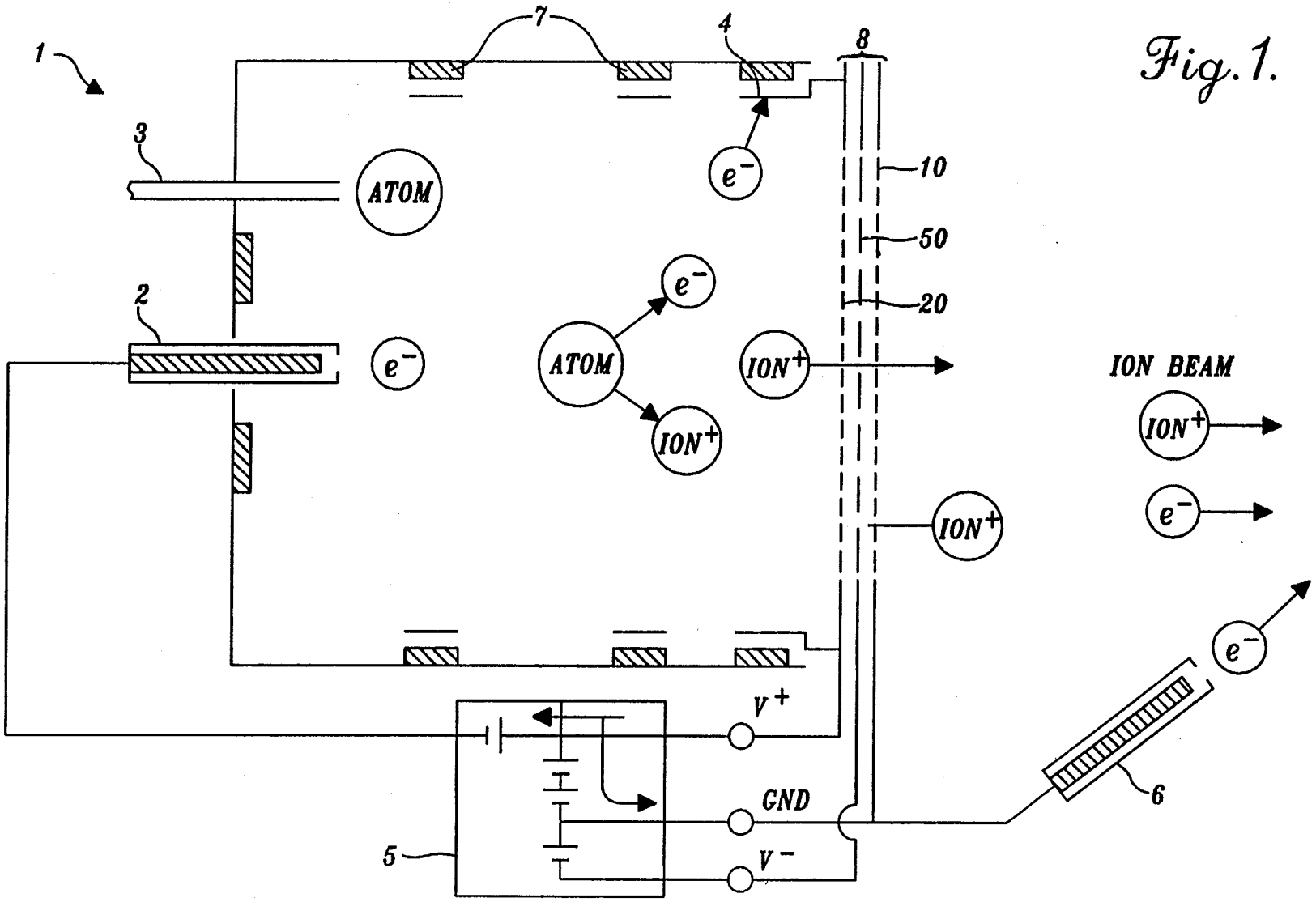
FIG. 1 is a schematic diagram of an ion thruster constructed in accordance with this invention.

The present invention is described in the context of an ion thruster 1, shown schematically in FIG. 1. This type of thruster is referred to as an electron-bombardment ion thruster, and includes a cathode 2, propellant feedline 3, anode 4, power supply 5, neutralizer 6, magnet 7, and ion optics 8. The general operation of an ion thruster is described in the Background of the Invention and is not repeated here.

Additional details regarding ion thrusters, and particularly ion optics 8, are set forth in Hedges and Meserole, *Demonstration and Evaluation of Carbon-Carbon Ion Optics,* to be published in JOURNAL OF PROPULSION AND POWER and Garner and Brophy, *Fabrication and Testing of Carbon-Carbon Grills for Ion Optics,* AMERICAN INSTITUTE OF AERONAUTICS AND ASTRONAUTICS, 92–3149 (1992), the disclosures of which are hereby incorporated by reference.

Figure 2:
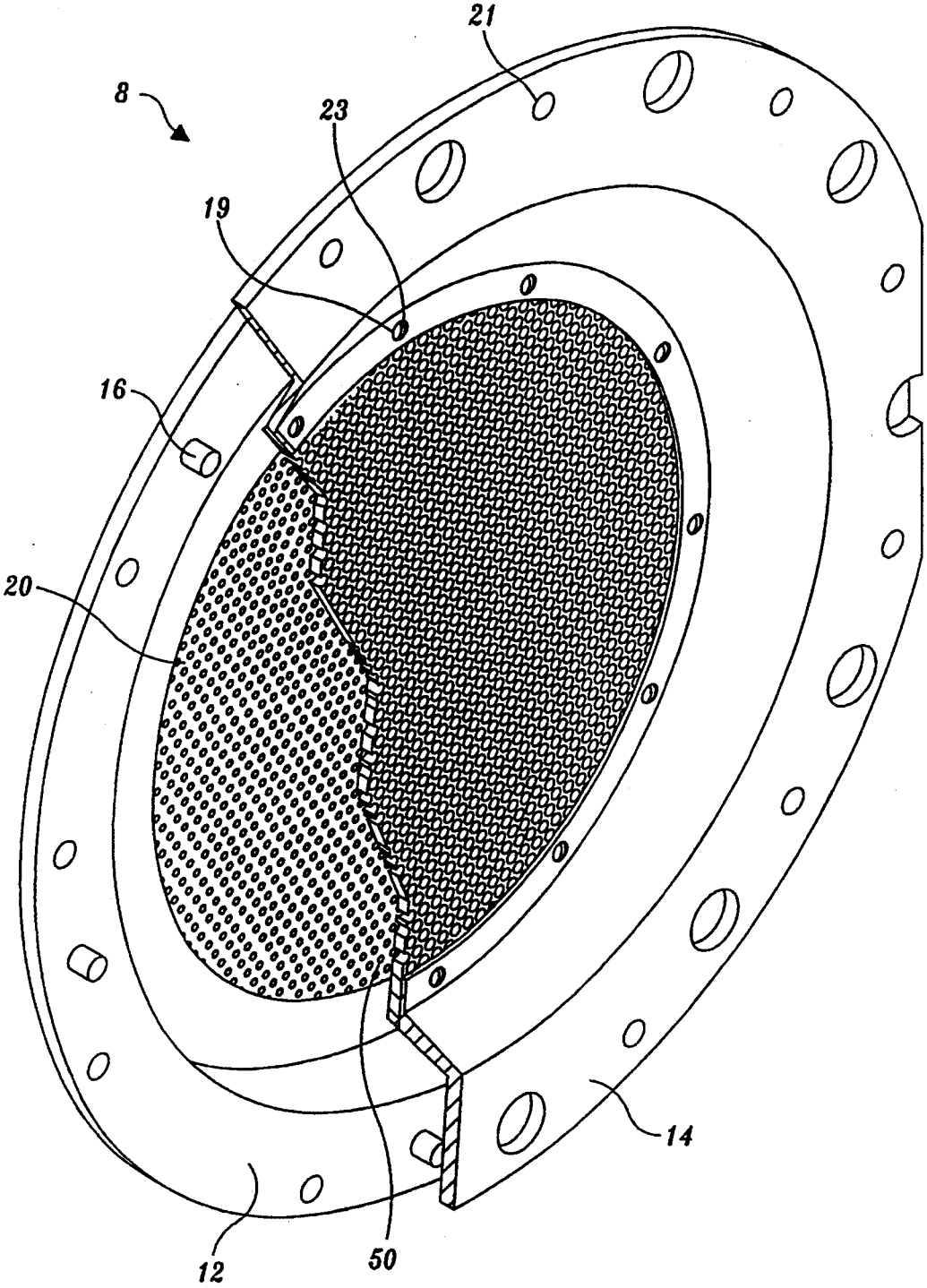
FIG. 2 is an illustration of ion optics included in the thruster of FIG. 1 and having grids and mounting rings constructed in accordance with this invention.

Referring now to FIG. 2, the ion optics set 8 is shown in greater detail, as including a screen grid 20 and an accelerator grid 50. An optional decelerator grid 10, shown in FIG. 1 but not FIG. 2, may also be employed. Screen grid 20 and accelerator grid 50 are secured to the frame of the ion thruster (not shown) by annular dish-shaped mounting rings 12 and 14, respectively, whose spacing is controlled by spacers 16. It should be understood that the benefits and advantages of the present invention will be applicable to ion beam sources that are used for applications other than ion thrusters.

Figure 10:
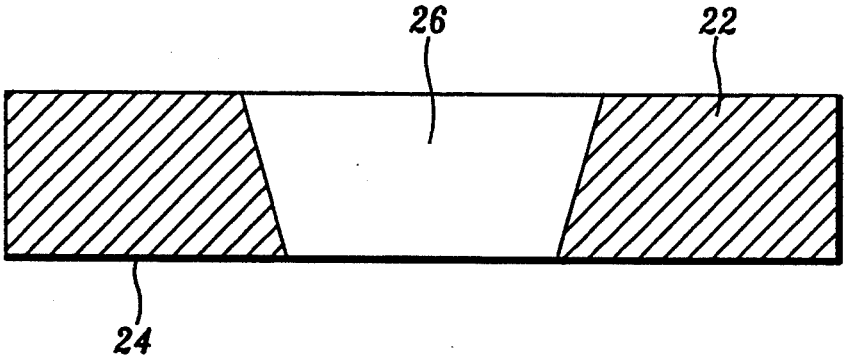
FIG. 10 is an elevational view of a cross section of an aperture in the screen grid of FIG. 2.

In the embodiment shown in FIG. 2, screen grid 20 is a substantially planar element that is a carbon-carbon composite comprising a carbon fiber array embedded in a carbon matrix. Referring additionally to FIG. 10, screen grid 20 includes an entry plane 22 and an opposing exit plane 24. As described in more detail below, entry plane 22 and exit plane 24 are substantially parallel which provides a screen grid of substantially uniform thickness. In the illustrated embodiment, screen grid 20 has a thickness on the order of about 0.8 millimeters (mm) and includes an array of apertures 26. Each aperture is approximately 10 centimeters (cm) in diameter. It should be understood that the foregoing dimensions are illustrative only; different diameters and thicknesses could be employed. For ion thrusters, it would be preferred to have the grids thinner, e.g., on the order of 0.4 mm, and larger in diameter, e.g., up to 50 cm or more, if possible. Thinner grids are preferred from the standpoint of increasing the electric field strength. Thickness is important from handling, assembly, and lifetime viewpoints, but the goal is to make the grids as thin as possible while retaining stiffness, uniformity, and the other required assembly properties.

Figure 3:
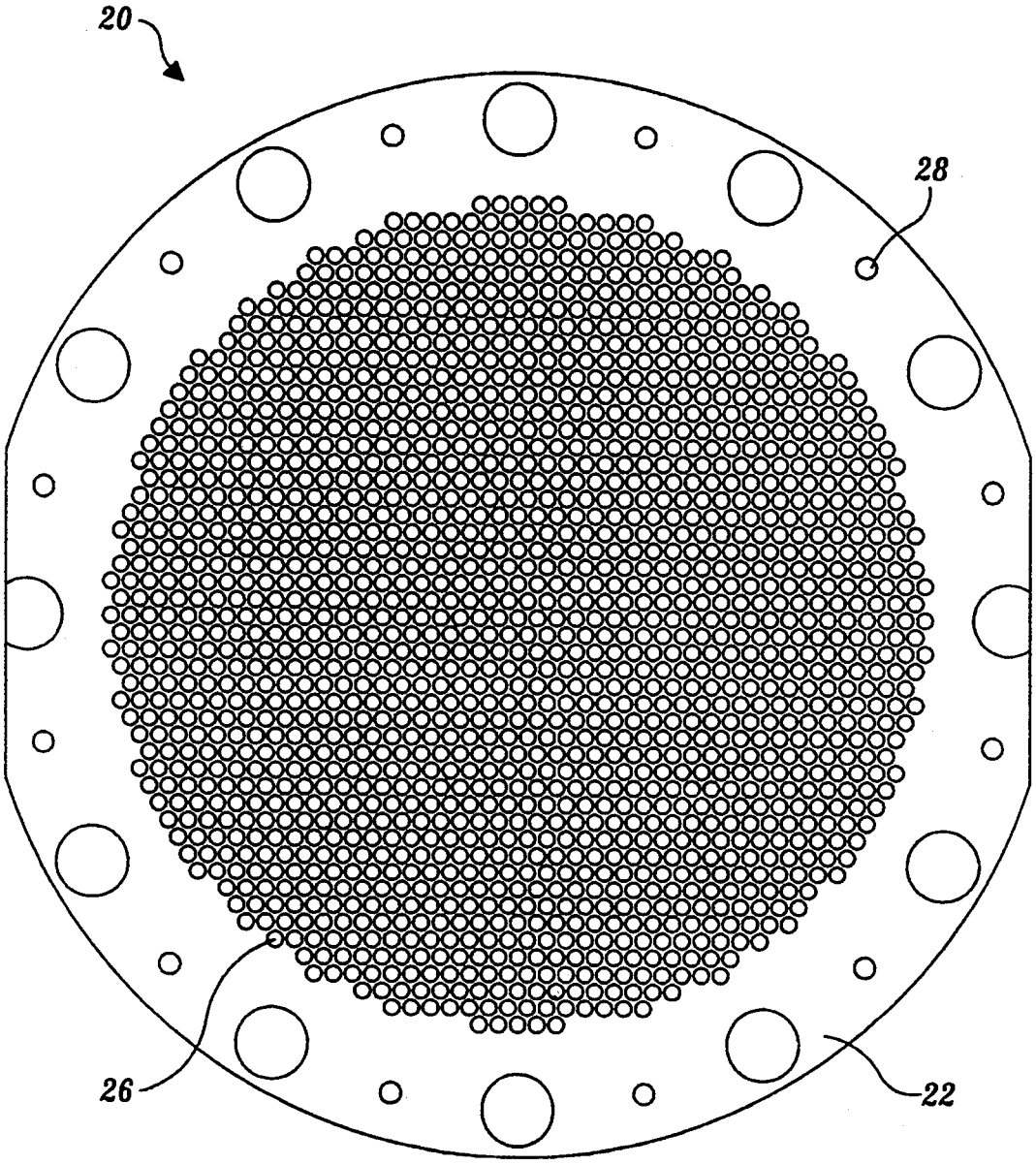
FIG. 3 is a plan view from the top of a screen grid formed in accordance with the present invention.

Adjacent the periphery of screen grid 20 are a plurality of equally spaced mounting holes 28, shown in FIG. 3, that extend through screen grid 20 from entry plane 22 to exit plane 24. As described above, the central portion of screen grid 20 includes a plurality of round apertures 26 that extend through screen grid 20 from entry plane 22 to exit plane 24. As shown in FIG. 10, apertures 26 have a diameter at entry plane 22 that is greater than the diameter at exit plane 24. In this manner, apertures 26 have a vertical profile that narrows from entry plane 22 to exit plane 24. In the illustrated embodiment, screen grid 20 includes approximately 1,600 apertures that have a hole diameter of approximately 1.83 mm. The open area fraction through screen grid 20, then, is about 0.59. The spacing between the center points of adjacent apertures 26 is approximately 2.29 min.

In the illustrated embodiment, apertures 26 in screen grid 20 are arranged in a hexagonal array. The hexagonal array provides an aperture at the center of a hexagon with other apertures centered on the intersection of the six sides of a hexagon. Such hexagonal array is more clearly illustrated in FIG. 7, which is a magnified view of a portion of entry plane 22 of screen grid 20.

Figure 6:
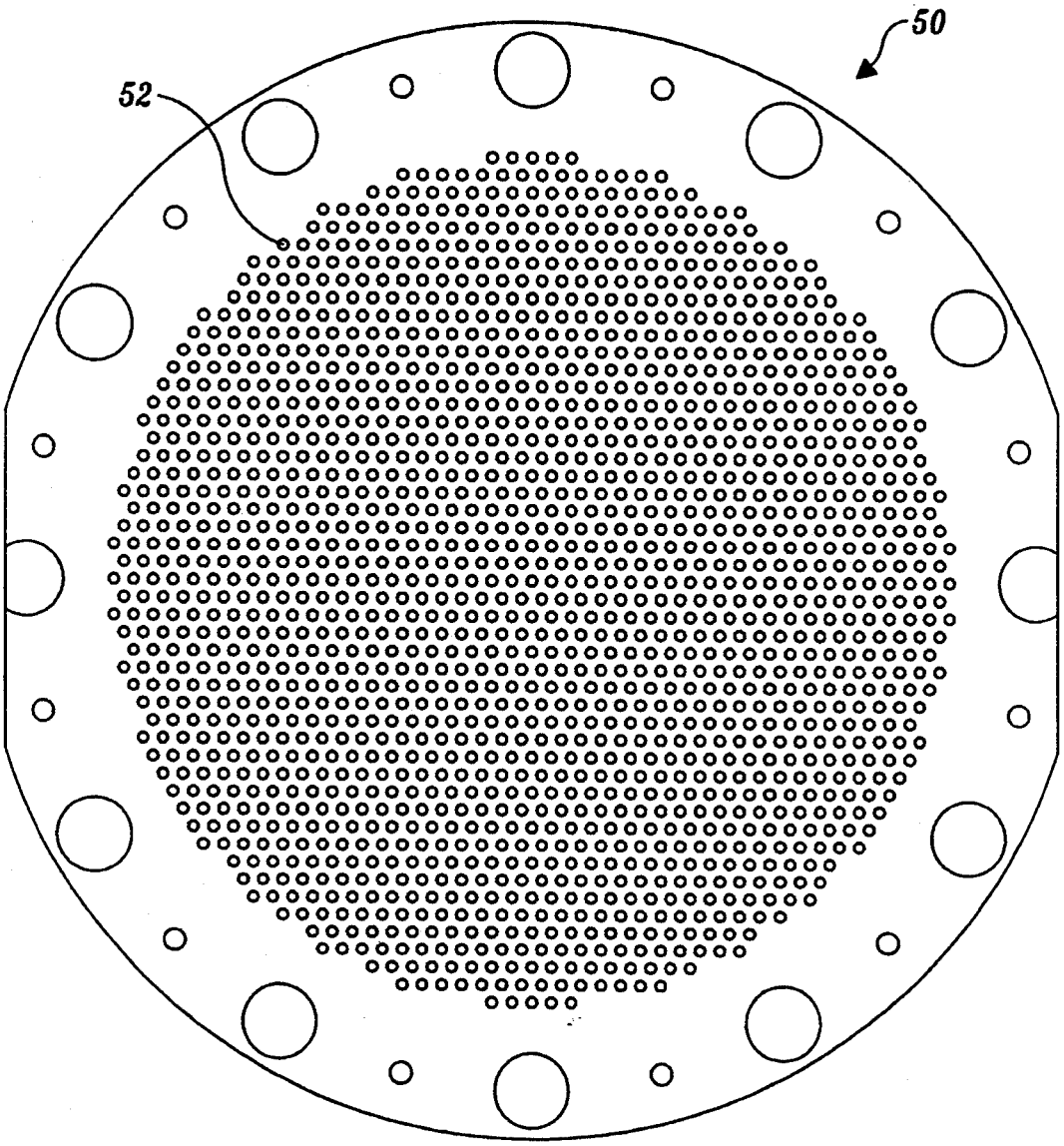
FIG. 6 is a plan view of the top of one embodiment of an accelerator grid formed in accordance with the present invention.
Figure 7:
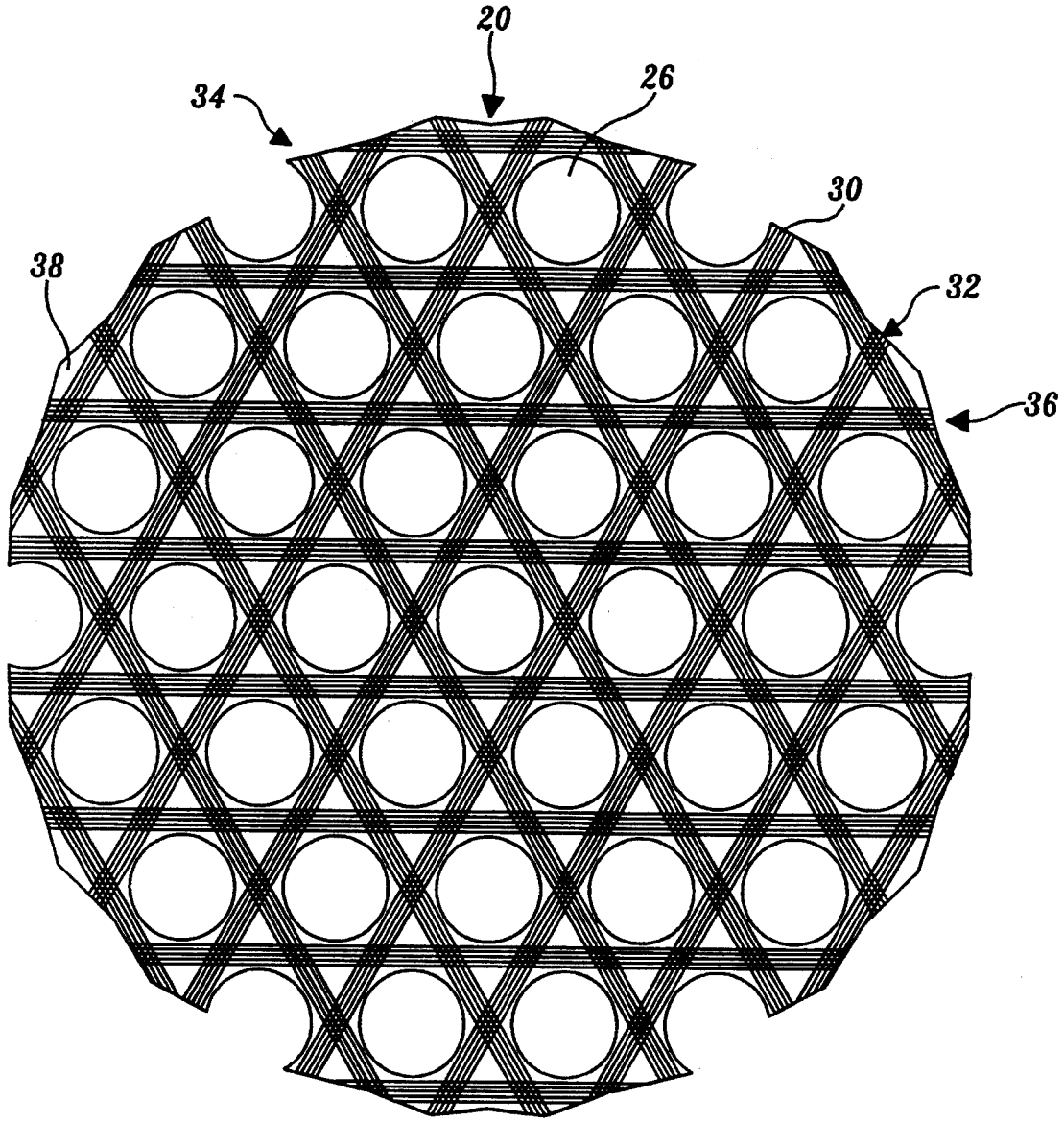
FIG. 7 is an enlarged plan view of a portion of the top of the screen grid of FIG. 1.
Figure 8:
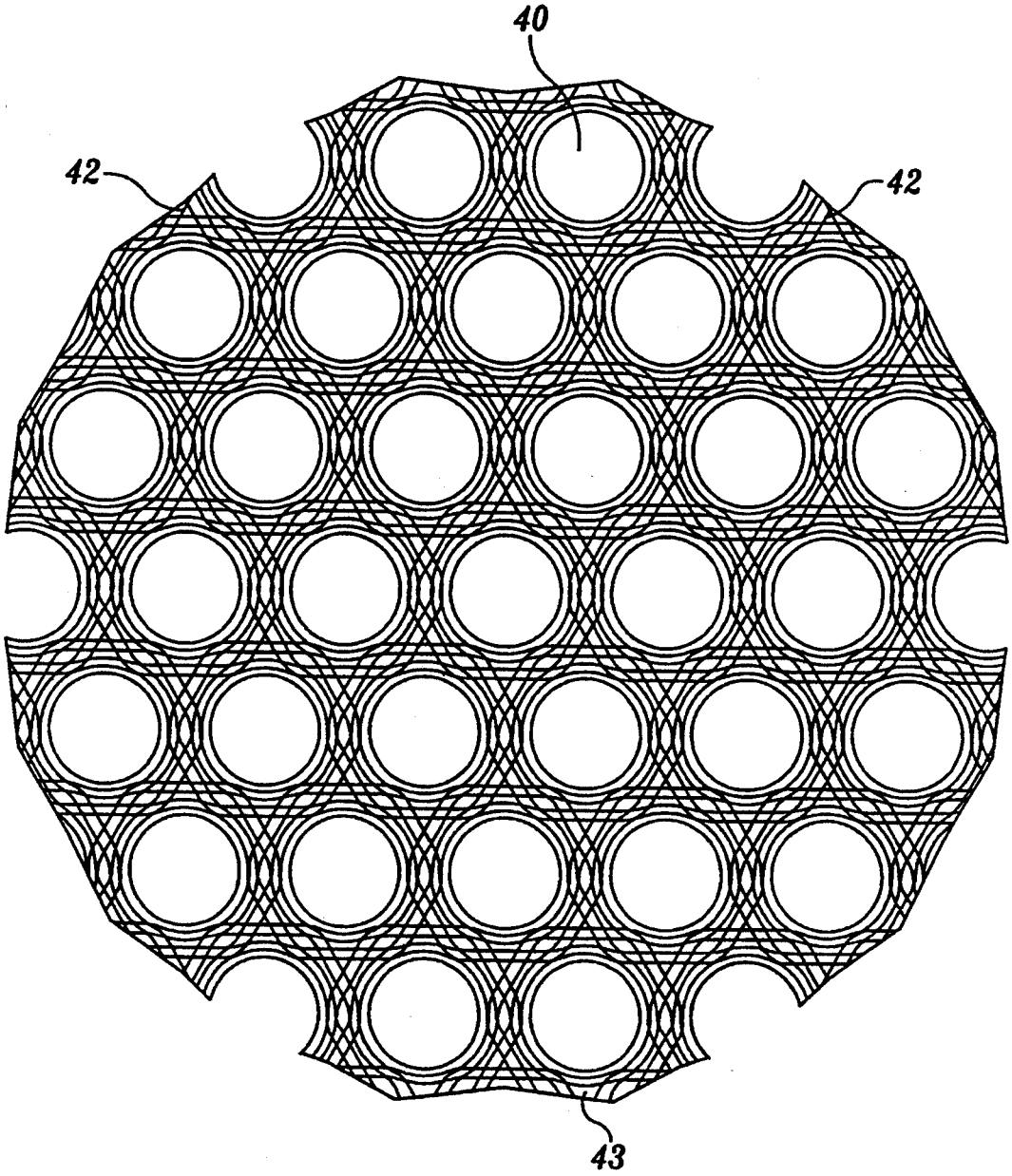
FIG. 8 is an enlarged plan view of a portion of the top of a screen grid formed in accordance with the present invention.

Referring to FIG. 7 in more detail, screen grid 20 includes carbon fibers 30 arranged in an array between apertures 26 and carbon matrix 38 that is infiltrated into the array. In the illustrated embodiment, carbon fibers 30 are arranged parallel to three different axes. Sets of carbon fibers 30 are arranged parallel to a first axis 32. Other carbon fibers 30 are arranged parallel to a second axis 34. In the illustrated embodiment, first axis 32 is offset from second axis 34 by 60°. A third group of fibers 30 is arranged parallel to a third axis 36. Third axis 36 is offset from both the first axis 32 and second axis 34 by 60°. In the illustrated embodiment, spacing between the periphery of apertures 26 is large enough that carbon fibers 30 can extend in a straight line from edge to edge of screen grid 20. As described below in more detail, when apertures 26 are larger and the carbon fibers cannot be run in a straight run from edge to edge, the carbon fibers can be "snaked" around the apertures, as shown in FIG. 8, where screen grid 20 includes fibers 42, carbon matrix 43, and apertures 40 that are larger diameter than apertures 26 illustrated in FIGS. 2 and 6. As noted above, when apertures 40 attain a certain diameter, carbon fibers 42 cannot extend in a straight line from edge to edge of screen grid 20. To achieve this "snaking" of the carbon fibers, the array can be laid up on a pattern of pegs or inserts that serve to define apertures 40.

It is also possible that in specific applications the size of the apertures passing through the screen grid will make it possible to have some fibers run in a straight line between the edges of the screen grid and other fibers that "snake" around the apertures.

Figure 4:
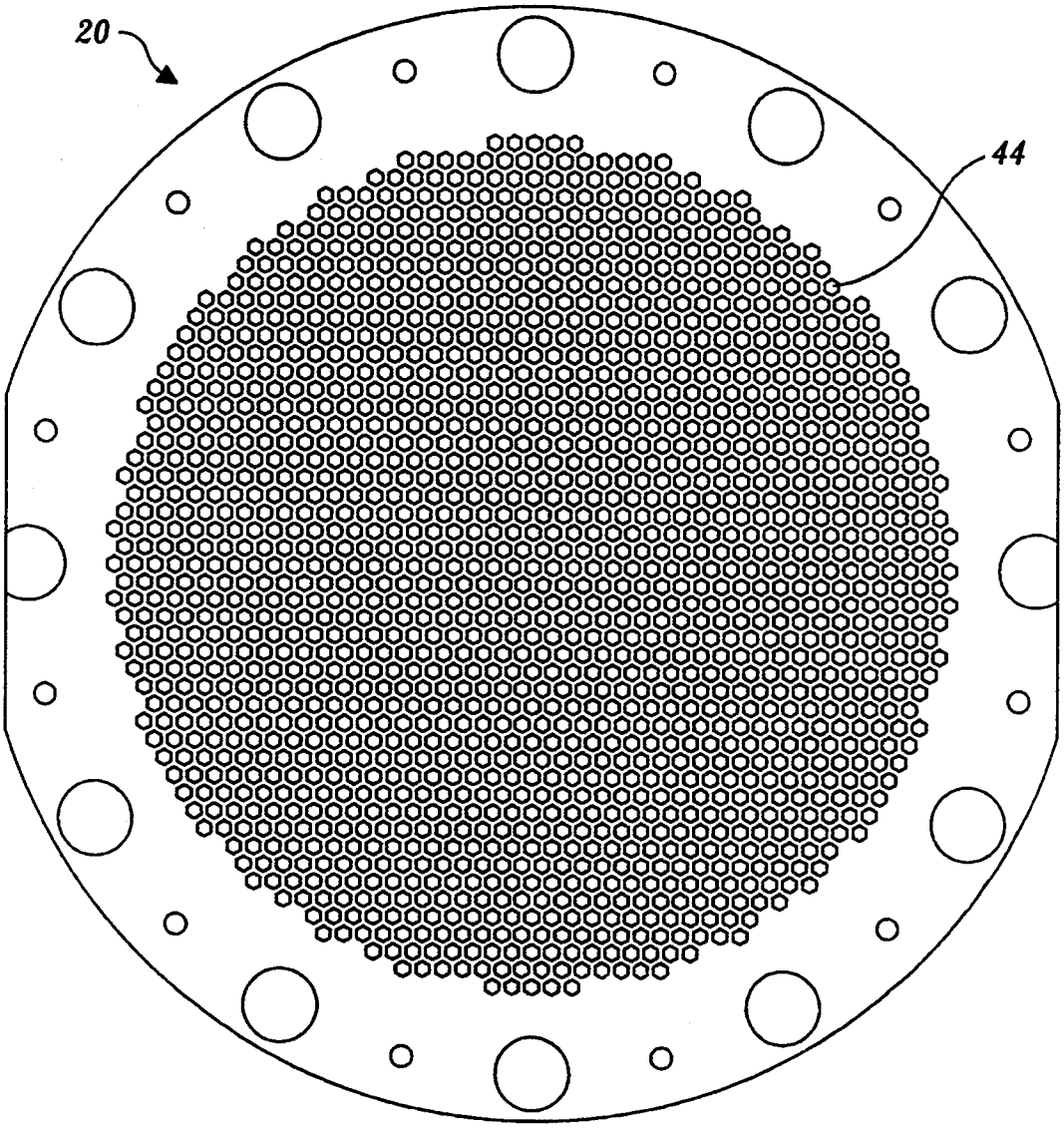
FIG. 4 is a plan view of the top of a second embodiment of a screen grid formed in accordance with the present invention.

Referring to FIG. 4, another embodiment of screen grid 20 is illustrated having apertures 44 that are hexagonal in shape and arranged in a hexagonal array. Depending on the dimensions of hexagonal apertures 44, carbon fibers can extend from edge to edge of the screen grid in a straight line or they may be "snaked" around hexagonal apertures 44 as described above. Under certain operating conditions, hexagonal holes may provide slightly better thruster performance than round holes.

Figure 5:
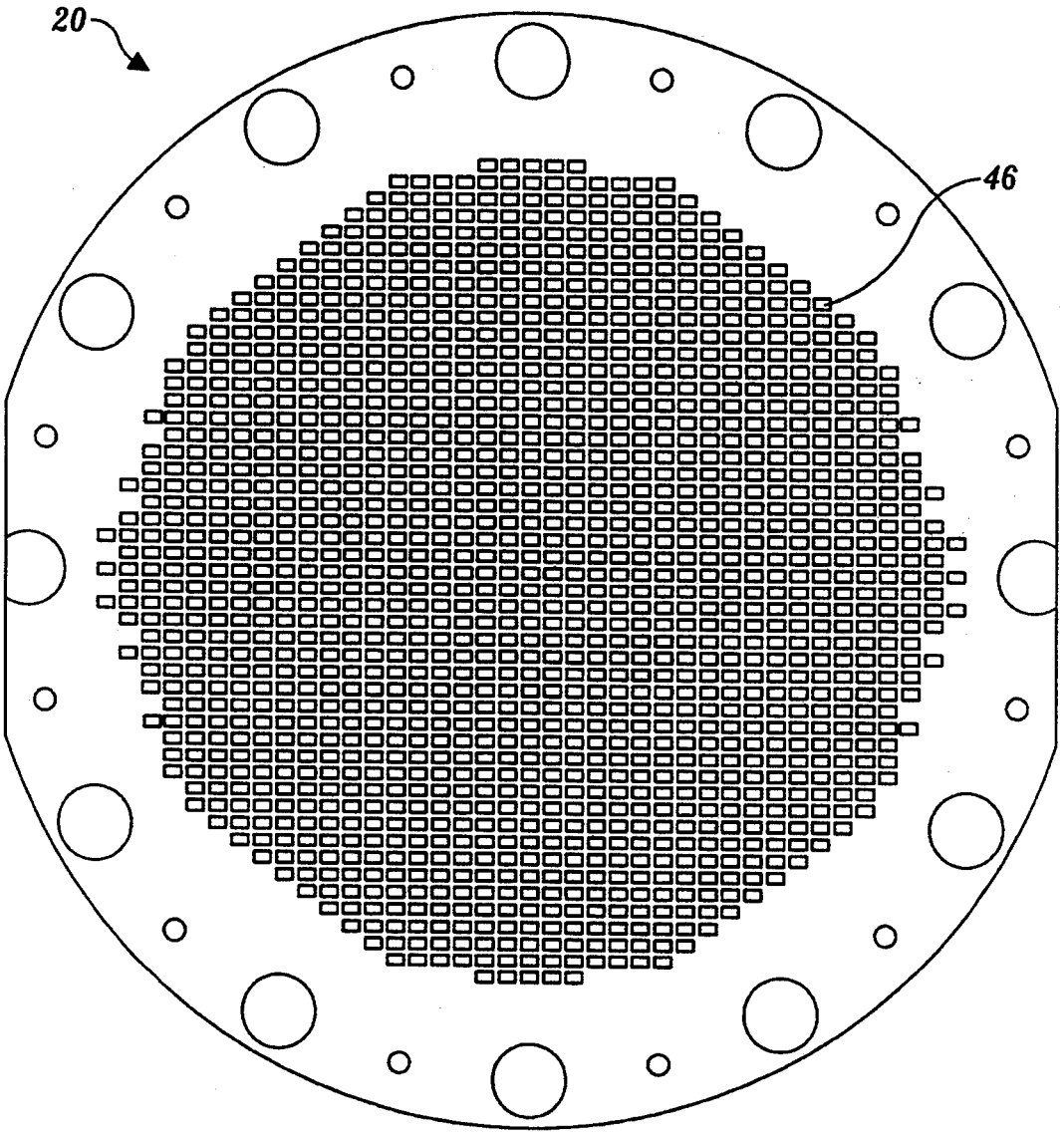
FIG. 5 is a plan view of the top of a third embodiment of a screen grid formed in accordance with the present invention.
Figure 9:
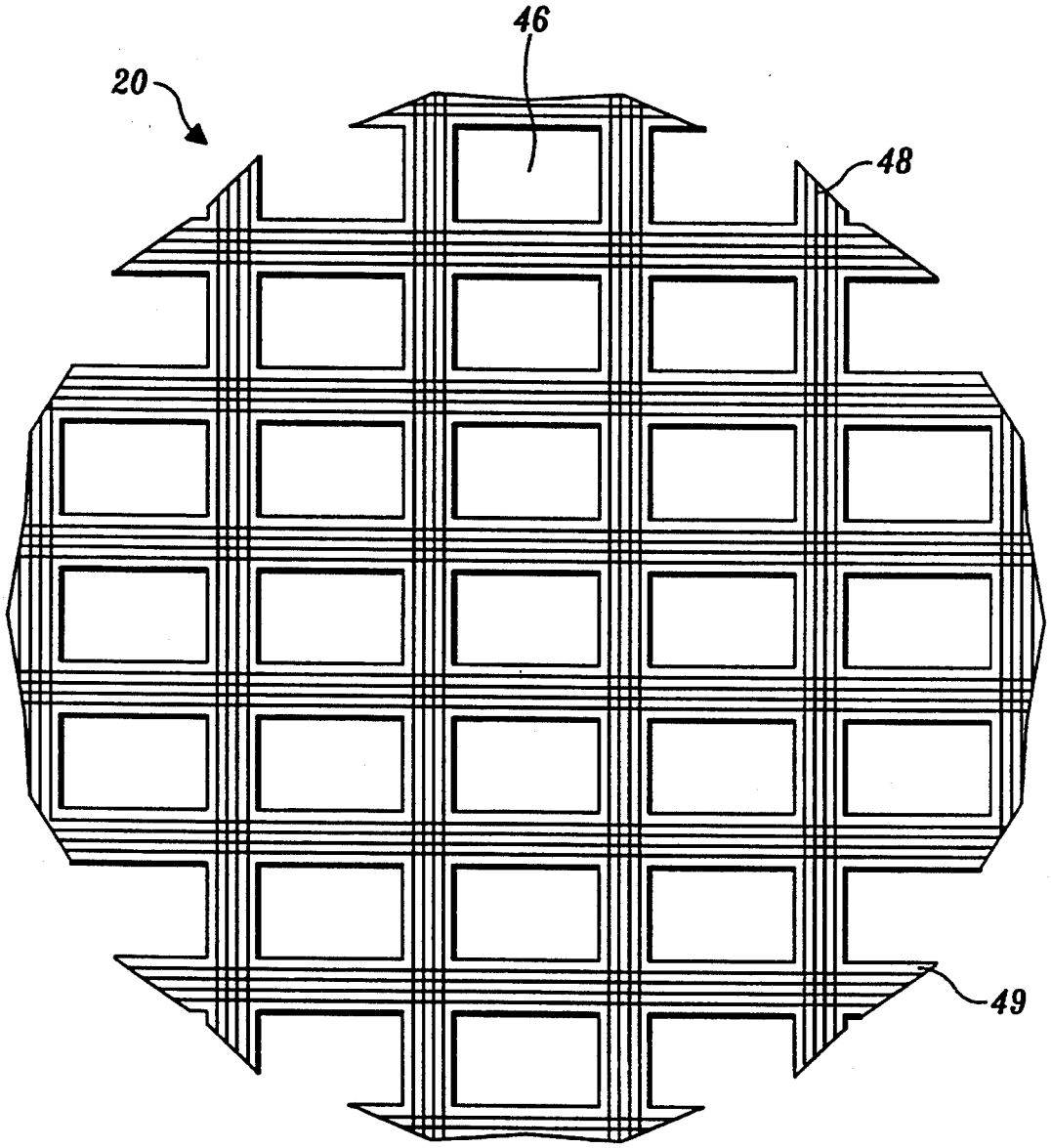
FIG. 9 is an enlarged plan view of a portion of the top of the screen grid of FIG. 5.

Referring to FIG. 5, another embodiment of screen grid 20 formed in accordance with the present invention is illustrated with apertures 46 that are rectangular in shape. When rectangular apertures 46 are employed, they can be arranged in orthogonal rows and columns or any other suitable arrangement. When apertures 46 are arranged in orthogonal rows and columns, carbon fibers 48 infiltrated with carbon matrix 49 extend in straight lines (FIG. 9) from edge to edge of the screen grid in an orthogonal array. This arrangement offers the advantage of providing orthogonal straight paths for the fibers across the entire grid, thereby maximizing the grid's stiffness.

As an alternative to arranging individual carbon fibers or tows of carbon fibers in the arrays described above, pre-woven sheets of carbon fibers can be arranged in layers to provide the needed carbon fiber array. When sheets of woven carbon fibers are used, the sheets can be arranged in layers that are offset, for example by 60°, from each other with respect to the direction of the weave or in any other suitable pattern. Pre-woven sheets of carbon fibers are preferred over the individual tows of fibers from an ease of handling perspective; however, the pre-woven sheets are generally thicker than the individual fibers or tows and therefore are not preferred from the standpoint of providing a thin grid.

Referring to FIG. 6, the accelerator grid 50 is substantially identical to screen grid 20 described above with the exception that the size of apertures 52 is much less so as to restrict the flow of neutral atoms out of the thruster. The electric field between the screen and accelerator grid is shaped so as to focus the ions passing through the large screen grid apertures into and through the smaller accelerator grid apertures. For example, for screen grid 20 described with reference to FIG. 2, a counterpart accelerator grid could include apertures 52 having a diameter of about 1.09 mm. Such an accelerator grid would have an open area fraction of about 0.29. Accelerator grid 50 has substantially the same number of apertures 52 as the screen grid and when the two are combined to form an ion optics pair, the axes of the apertures of the screen grid and the axes of the apertures of the accelerator grid are aligned.

The screen grid and the accelerator grid can both include hexagonal apertures or rectangular apertures arranged in the same manner as described above, or other arrays suitable for the application. Similarly, one could vary the size of apertures as a function of their position in the grids to match the distribution of plasma over the grids.

Figure 11:
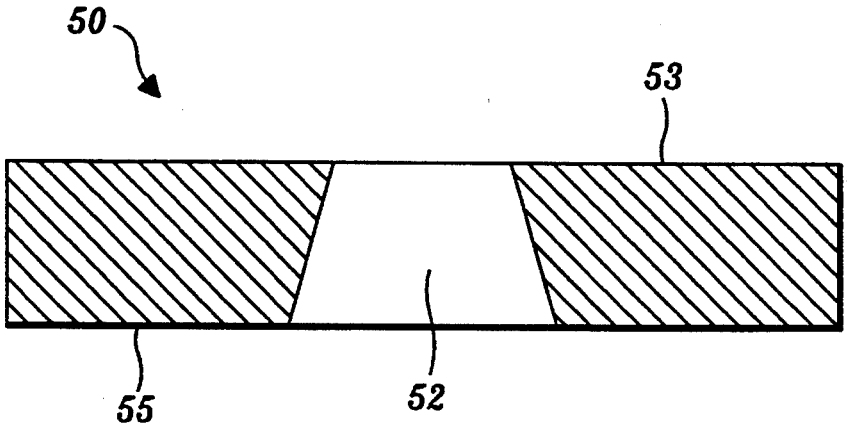
FIG. 11 is an elevational view of a cross section of an aperture in the accelerator grid of FIG. 6.

Referring to FIG. 11, as with the screen grids, accelerator grid 50 includes an entry plane 53 and an opposing exit plane 55. Entry plane 53 and exit plane 55 are substantially parallel so that the accelerator grid has a substantially uniform thickness. The diameter of aperture 52 at entry plane 53 is less than the diameter of aperture 52 at exit plane 55. In this manner, aperture 52 has a profile through accelerator grid 50 that is tapered from entry plane 53 to exit plane 55.

The carbon fibers that can be used in the context of the present invention include those that are commercially available from a number of sources, including the K-1100 high modulus fiber available from the Amoco Company or the E-55 fiber available from the DuPont Company. Such fibers are usually drawn and may be interwoven to provide tows or sheets of fibers. The fibers available exhibit a range of physical properties. For ion thrusters, fibers having an elastic modulus on the order of $4\times10^5$ MPa to $1\times10^6$ MPa and a diameter of about 10 microns are suitable. Carbon fibers having an elastic modulus on the upper end of the foregoing range will generally allow thinner grids of adequate overall stiffness to be made than will carbon fibers having an elastic modulus near the lower end of the range.

Stiffer fibers are generally preferred; however, they should also have commensurate strength so as not to be brittle and fragile during handling. Grids made with carbon fibers near the lower end of the range will require appropriate thermal processing after forming to increase the fiber modulus to a higher value, preferably above 100 million psi.

A carbon matrix is built around the carbon fiber array by a repetitive process. Each repetition of the process involves the steps of infiltration with a carbonaceous material, as described below, and high-temperature pyrolysis. The carbonaceous materials can be pitch, resin, or organic gases. A combination of these materials also may be used, although only one material is used in any given infiltration and pyrolysis sequence. Pyrolysis is a thermal process which decomposes the carbonaceous precursor material to leave a residue of pure carbon as the carbon matrix around the carbon fiber array. The process of building the carbon matrix is referred to as densification because the density is increased as fibers become embedded in the carbon matrix.

Pitch and resin infiltration is accomplished by pouring or squeezing the pitch or resin into the carbon fiber array. This infiltration can also be effected by using carbon fibers or tows of carbon fibers that have been laid up on a tape and preimpregnated with pitch or a phenolic polymer. Two companies that perform pitch or resin infiltration are Fiber Materials, Inc., of Biddeford, Me. and Kaiser Aerotech of San Leandro, Calif.

Organic gas infiltration, otherwise known as chemical vapor infiltration, is generally carried out in a controlled atmosphere furnace where an organic gas infiltrates the carbon fiber array, decomposes at the surfaces, and leaves a carbon residue which binds the fibers together and forms a continuous matrix. One company that provides chemical vapor infiltration services is B. F. Goodrich of Sante Fe Springs, Calif.

Although the described screen and accelerator grids are planar, in certain applications, it may be desirable to curve the grid a small amount to add stiffness.

As noted previously, the screen grid 20 and accelerator grid 50 are coupled to the frame of the ion thruster by mounting rings 12 and 14. Rings 12 and 14 are also preferably formed using the same carbon-carbon composite employed in the grids, although alternative materials can be employed. A greater variety of fiber arrays can also be used in rings 12 and 14, given the absence of the grid apertures. Each ring includes a central opening 18 dimensioned to enclose the apertured region of the grid it is used with. Each ring includes a plurality of grid mounting holes 19 and frame mounting holes 21.

The mounting rings 12 and 14 are attached to grids 20 and 50 via the grid mounting holes 19 and mounting screws 23. The rings are also attached to the thruster frame by screws (not shown). Alignment pins would typically be employed to achieve the desired relative alignment of these various components.

The carbon-carbon grids and mounting rings do not expand upon heating. In fact, they might contract, but only slightly. Their coefficient of thermal expansion is essentially zero. Since expansion of the grids and mounting rings is negligible over the operational temperature gradients, which can be on the order of 350 degrees Celsius, alignment of the apertures and a constant spacing between the screen grid and the accelerator grids can be better maintained. When spacing between the grids can be reliably maintained constant during the operational temperature changes, the grids can be spaced closer together without the risk that expansion will cause the grids to touch each other and be electrically shorted together, or that the beam density will be excessive where the gap is smaller than intended. Shorting destroys the voltage gradient needed to accelerate the ions. Excessive beam densities increase the production of charge exchange ions that increase grid erosion. Also, when the spacing can be maintained constant, larger grid diameters can be designed without increasing the likelihood that thermal expansion will adversely affect performance. Large grid diameters can translate into efficiency, thrust-to-weight, and reliability advantages.

In addition to the foregoing advantages, carbon-carbon grids are more resistant to erosion by ions than the materials used today to make grids, such as molybdenum. Space applications require that such grids have a lifetime on the order of 10,000 hours. Carbon-carbon grids formed in accordance with the present invention show potential to exceed such lifetimes without restrictions imposed on the thruster operating conditions (specifically, without limiting the beam density for the purpose of reducing the erosion rate).

In accordance with the present invention, the screen and accelerator grids can be combined in a conventional manner to provide an ion optics set 8, as shown in FIG. 2, for use in the ion thruster 1 or other ion beam sources. When the carbon-carbon composite screen and accelerator grids are used in an ion optics set 8, grid spacings of approximately 0.2 mm to 0.5 mm can be used. Grid spacing outside the exemplary range given above can be employed in accordance with the present invention. The narrow grid spacing described above is achievable with the carbon-carbon grids because the thermal-mechanical stability of the carbon-carbon composite and the stiffness of the grids allows the screen and accelerator grids to be spaced closer together than conventional grids. The use of carbon-carbon composites for the mounting rings further contributes to the thermal-mechanical stability of the ion optics, hence, the ability of the grids to be closely spaced. Spacing the grids closer together increases the field strength between the grid, which increases the maximum achievable beam density. A carbon-carbon grid set is tested for voltage stand-off capability, maximum perveance condition, electron backstreaming limit and defocusing limit in the example that forms a part of this detailed description.

Generally, the fabrication of the grids described above includes selecting a high-modulus carbon fiber, an appropriate lay-up pattern, a suitable means of densification, and a method for making apertures of the desired shape and arrangement. Minimizing the thicknesses of the screen grid and accelerator grid, subject to structural and erosion constraints, is also an important design consideration.

The carbon fibers can be laid up on a solid substrate in any of the patterns described above. The substrate that is chosen should be compatible with the subsequent infiltrating step. For example, a flat carbon block may be suitable as a base for laying up the fibers. The carbon fibers should be laid up in as dense an arrangement as possible given the desired thickness of the particular grid. Thinner grids may be desirable; however, as the grids are made thinner, care must be taken that they do not become too flexible. With respect to the particular form of the fiber chosen, tapes of fibers or tows are preferred over woven fabrics since woven fabrics tend to introduce added thickness at the points of the overlapping weaves and the curing of the fibers in the weave reduces the effective grid stiffness. When fabric is used, the fibers may be used in an amount that they comprise approximately 50–65 volume percent of the overall grid and when a tape is used the fibers comprise approximately 75–90 volume percent of the grid. Generally, the higher the volume percent fibers, the stiffer the grid.

As described above, the lay-up of fibers can be densified using techniques such as pitch infiltration, resin infiltration, or chemical vapor infiltration. Pitch infiltration can be used to fill the larger internal voids and the smaller voids can be filled with chemical vapor infiltration. Since neither densification method provides a void-free body, to improve the erosion resistance, internal voids exposed when the apertures are cut, as described below in more detail, should be filled by chemical vapor infiltration. The densification steps preferably provide a carbon-carbon composite having a density greater than 1.9 g/cm$^3$. Accordingly, when the grid comprises about 50 volume percent fibers, the carbon matrix will comprise approximately 50 volume percent of the grid. Similarly, when the grid comprises about 90 volume percent fibers, the carbon matrix will comprise approximately 10 volume percent of the grid.

The apertures in the grids can be cut by several different methods. For example, for round apertures, you can use mechanical drilling with diamond tip drills, or faster cutting methods, such as laser cutting, ultrasonic milling, water jet cutting, or electron discharge machining, can be employed.

For some applications, you may prefer to employ a technique providing uniformly tapered apertures of the type described above. Such apertures advantageously enable a wider range of operating conditions without the beam impinging upon the side walls of the apertures. As a result, thicker grids can be employed to achieve the desired grid stiffness, without incurring a performance penalty. You may also wish to remove the "sharp" perimeter of the openings of the aperture to reduce erosional effects at the openings.

Alternatively, you can form the apertures by providing a pattern of pegs or other inserts around which the carbon fibers are laid up and around which the carbon infiltration of the array is carried out. In this manner, the apertures will be preformed rather than requiring subsequent drilling after infiltration.

EXAMPLE

We made a 10-cm diameter, flat, circular screen grid and a 10-cm diameter, flat, circular accelerator grid from two 14-cm square carbon-carbon panels we obtained from B. F. Goodrich of Sante Fe Springs, Calif. The panels consisted of three plys of carbon fiber fabric densified by chemical vapor infiltration. The fibers making up the fabric had an elastic modulus of about 105 million psi. The infiltrated panels were 0.8 mm thick and were machined to include 1,615 apertures. The apertures in the accelerator grid had a diameter of 1.09 mm and the apertures in the screen grid were 1.83 mm in diameter. The screen grid had an open area fraction of 0.59 and the accelerator grid had an open area fraction of 0.21. Hole spacing between the apertures in both grids was 2.29 mm and the hole profile was a tapered 6° cut, which was a result of the particular laser cutting operation used to produce the apertures.

No special surface preparation, either cleaning or smoothing, was done prior to testing. The laser machining process left a soot-like discoloration on the laser entry side of each grid. The surface roughness due to the fiber weave was about 0.05 mm. When mounted, these grids were measured to be flat to within 0.025 mm.

Optics tests were conducted using a 15-cm ion source produced by Ion Tech, Inc. of Fort Collins, Colo. An adapter was used to mask down the 15-cm source to 10 cm and to accept a separate conventional molybdenum grid mount that was used to mount the carbon-carbon grids.

The ion source used tungsten filaments for both the cathode and the neutralizer. Variable alternating current sources (variacs) drove the cathode and neutralizer. We isolated the cathode from its variac using an isolation transformer. The beam supply was rated at 3,000 volts and 1 amp and was referenced to facility ground. The discharge supply floated at beam potential with its positive terminal connected to the positive terminal of the beam supply and its negative terminal connected to tile mid-point of the secondary winding on the cathode isolation transformer. The discharge supply was rated at 200 volts and 17 amps. The accelerator supply was rated at 600 volts and 1.5 amps. The tests were conducted using xenon as the propellant, although other inert gases (such as argon and krypton), or other elements or molecules (such as mercury, or carbon-60) can be employed.

We conducted the tests in a diffusion pumped vacuum chamber, 0.9 meters in diameter by 1.8 meters in height, that maintained approximately $5\times10^{-5}$ tort during testing. With a digital data acquisition system, beam voltage and current, accelerator grid voltage and current, discharge voltage and current, cathode filament current, neutralizer filament, and emission current, and propellant flow were measured. Vacuum chamber pressure was measured with an ion gauge.

Before operating the grids on the thruster, we conducted voltage standoff tests. The optics set was mounted to the molybdenum grid mount, gapped to 0.58 mm and then tested until voltage breakdown occurred in both air and vacuum using a high voltage, variable DC power supply. A 100K ohm power resistor was placed in series with the high voltage power supply to limit the current when arcing occurred.

With the carbon-carbon grids installed in the grid mount at a gap setting of 0.58 mm, and exposed to atmospheric conditions, we increased the voltage across the grids slowly. Arcing was observed initially as the voltage was increased above 1,000 volts, but by pausing the increase at each occurrence, the rate of arcing decreased, and eventually stopped. The voltage was increased to 2,500 volts. After some initial arcing, the voltage was held at 2,500 volts for several minutes until no further arcing was observed. The voltage gradient at that point was 4,300 volts per min. Inspection of the grids under a microscope following the tests showed that the arcing had no visible effect on the grids, other than to produce some slight, localized surface discoloration.

We repeated the procedure in a vacuum chamber pumped down to $1\times10^{-5}$ torr. No arcing was visible up to 3,500 volts. At 3,500 volts, a small, steady current of about 0.5 milliamps was observed on the power supply analog current meter. At 3,750 volts, arcing began, but it subsided with time. Eventually, 5,000 volts with only occasional arcing was reached, but a steady current of 1 milliamp was recorded. At 5,250 volts, arcing was observed. At 5250 volts, the voltage gradient was 9050

V/mm. Maximum voltage gradients of 6420 V/mm during operation at 0.2 mm spacing for the carbon-carbon grids was also observed.

Three grid-to-grid gaps of 0.2 mm, 0.3 mm, and 0.5 mm were chosen at which to operate the thruster. These gaps provided effective acceleration lengths of 1.35 mm, 1.42 mm, and 1.58 min.

Prior to starting the thruster for each run, the chamber background pressure was recorded while xenon flowed at the rate desired for that run. The thruster was then started and allowed to warm up for at least 30 minutes prior to data acquisition. For all runs, the initial run conditions were as follows:

(1) the propellant utilization efficiency ($\eta_p$) was set to approximately 75%, determined by the ratio of beam current to propellant flow rate, where flow rate was convened to an equivalent current flow using 1 amp equal to 13.95 standard cubic centimeters per minute for singly ionized atoms.

(2) the discharge voltage $V_d$ was set to 35 volts, which was less than or equal to 10% of the total accelerating voltage $V_t$. The total accelerating voltage is given by $V_t = V_b + |V_a|$ where $V_b$ is the beam (and also the net accelerating) voltage and $|V_a|$ is the absolute value of the accelerator grid voltage.

(3) the net to total voltage ratio R was set to 0.8, where $R = V_b/V_t$; and (4) the total voltage was set high enough to preclude direct ion impingement (by choosing a $V_t$ such that further increases in $V_t$ at a fixed R did not reduce accelerator grid impingement current).

Figure 12:
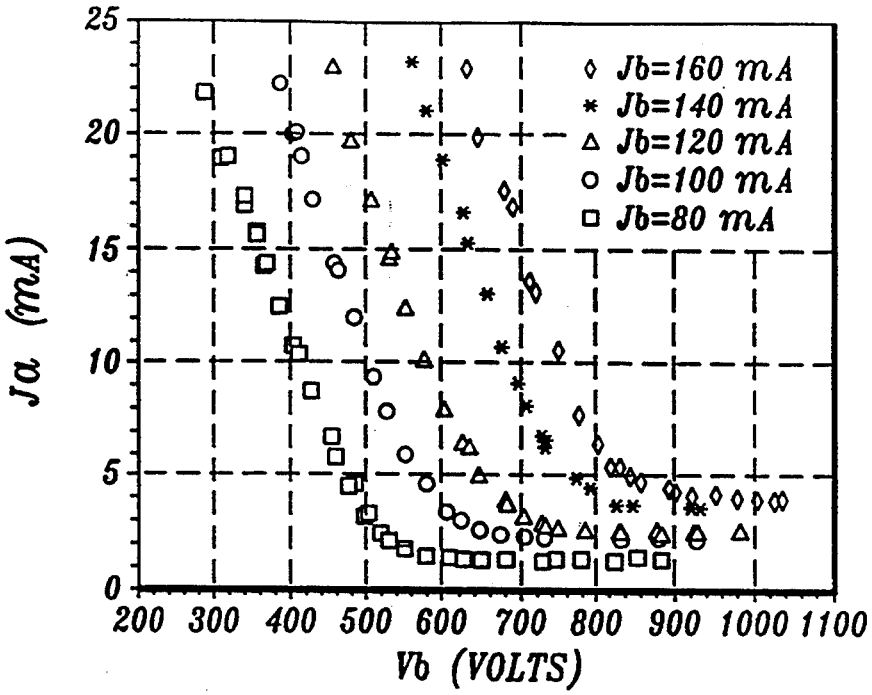
FIG. 12 is a graph of accelerator grid impingement current ($J_a$) as a function of beam voltage ($V_b$) for an ion optics set formed in accordance with the present invention.

Perveance expresses total current in terms of applied voltage. For a fixed beam current, the maximum perveance condition of an ion optics set occurs at the minimum total voltage ($V_t$) prior to the onset of direct ion impingement. For the carbon-carbon grids, we measured accelerator grid impingement current as a function of decreasing beam voltage to identity the minimum total voltage prior to direct ion impingement. We made measurements for each of five beam current ($J_b$) levels from 80 milliamps to 160 milliamps, and for an acceleration length of 1.35 mm. We held beam current constant by adjusting the discharge current as necessary in response to changes in the beam voltage. Accelerator grid voltage was fixed for each run. FIG. 12 shows a representative plot of accelerator grid impingement current ($J_a$) as a function of beam voltage ($V_b$) for the carbon-carbon optics.

Electron backstreaming occurs when the accelerator grid voltage is no longer sufficient to shield external electrons from the positive potential of the discharge chamber. Electrons are then free to flow from the external environment into the discharge chamber.

Figure 13:
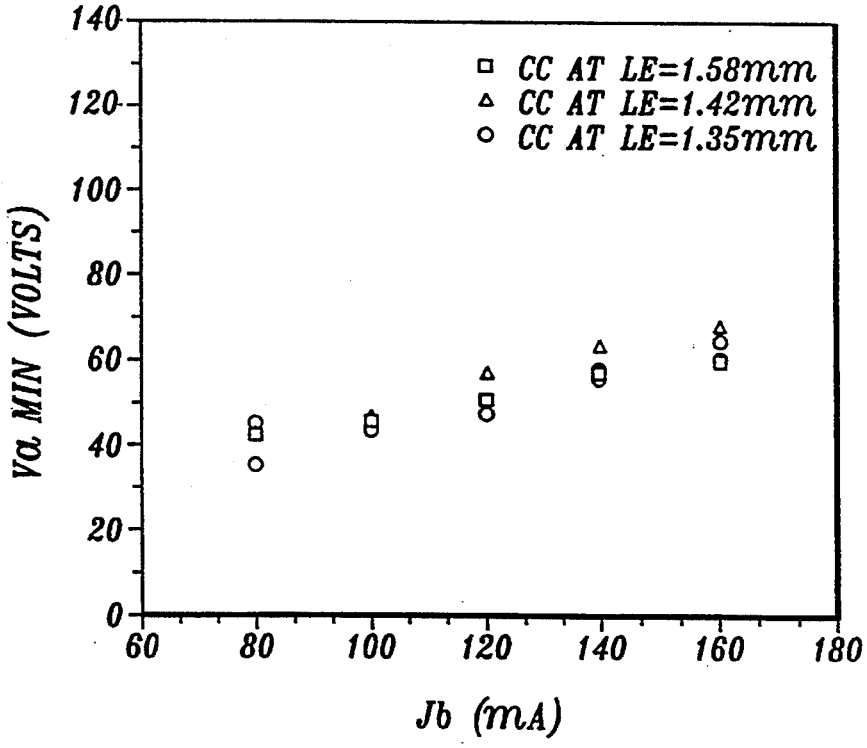
FIG. 13 is a graph of accelerator grid voltage ($V_a$) as a function of beam current ($J_b$) for an ion optics set formed in accordance with the present invention.

After completing each data run for determining the maximum perveance condition, the initial conditions were reestablished and then beam current ($J_b$) was measured as a function of decreasing accelerator grid voltage ($V_a$) for each of the effective acceleration lengths. The accelerator grid voltage was slowly reduced as the analog current meter on the beam supply was monitored. As the accelerator grid voltage fell below the electron backstreaming limit, a rapid increase in beam current was observed. The accelerator grid voltage at which this beam current occurred was recorded as the electron backstreaming limit. FIG. 13 represents plots of the electron backstreaming limit for each run.

Figure 14:
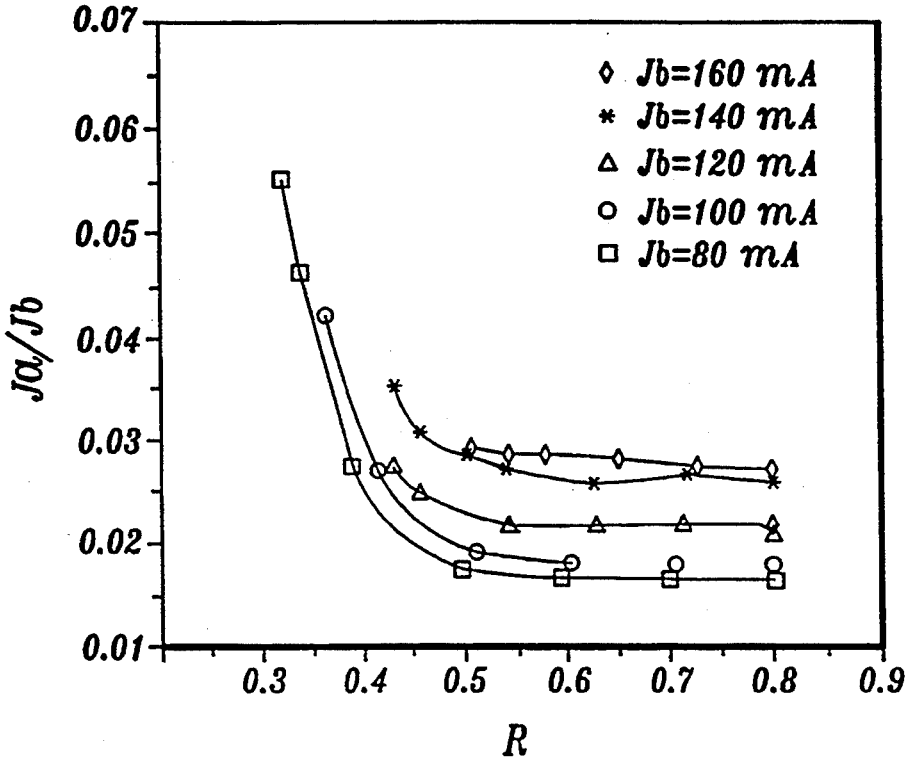
FIG. 14 is a graph of the ratio of accelerator grid impingement current ($J_a$) to beam current ($J_b$) as a function of net-to-total voltage ratio ($R=V_b/V_t$) for an ion optics set formed in accordance with the present invention.

After completing each data run for determining the electron backstreaming limit, the initial run conditions were reestablished. For an effective acceleration length of 1.42 mm, accelerator grid impingement current as a function of net-to-total voltage ratio (R) was measured while holding total voltage ($V_t$) constant. This determined the minimum R prior to the onset of direct ion impingement. For the selected total voltage, R was adjusted down from an initial value of 0.8 by decreasing the beam voltage, then increasing the accelerator grid voltage by the same amount, thereby lowering the beam (net) voltage while maintaining a fixed total voltage. At each step, accelerator grid impingement current was recorded. As the defocusing limit was approached, the accelerator grid impingement current increased from the background level. The value of R at which the accelerator grid current first increased above the background level was identified as the defocusing limit for each run condition. FIG. 14 shows the ratio of accelerator grid impingement current ($J_a$) to beam current ($J_b$) plotted as a function of R. For the carbon-carbon optics at an effective acceleration length of 1.42 millimeters, the defocusing limit occurred for R values between 0.4 and 0.5.

During these tests, we did not observe buckling or breaking of the ion optics. Accordingly, this test also demonstrates how fiat carbon-carbon ion optics made have sufficient thermomechanical stability to operate with grid spacings on the order of 0.2 mm.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A grid element, for use in an ion optics set for an ion beam source, comprising:

a substantially planar body of substantially uniform thickness and adapted for use in the ion optics set and including a regular spaced array of apertures of substantially uniform shape and area, passing therethrough, said body comprising a carbon-carbon composite of carbon fibers and a carbon matrix, the areas of said body and said apertures being related by a predetermined open area fraction, the composite having a coefficient of thermal expansion substantially equal to zero.

2. A grid element for use in an ion optics set of an ion beam source, comprising:

a body adapted for use in the ion optics set and including an array of apertures passing therethrough, said body comprising a carbon-carbon composite of carbon fibers and a carbon matrix, the areas of said body and said apertures being related by a predetermined open area fraction, the composite having a coefficient of thermal expansion substantially equal to zero, wherein the apertures have a tapered profile.

3. The grid element of claim 2, wherein said carbon fibers have an elastic modulus ranging above about $4 \times 10^5$ MPa.

4. The grid element of claim 3, wherein said elastic modulus ranges between about $7 \times 10^5$ MPa to about $1 \times 10^6$ MPa.

5. The grid element of claim 2, wherein said carbon fibers extend continuously from one edge of the grid element to an opposite edge of the grid element.

6. The grid element of claim 2, wherein said carbon fibers are oriented parallel to a first axis, parallel to a second axis offset from the first axis by about 60 degrees, and parallel to a third axis offset from the first axis and the second axis by about 60 degrees.

7. The grid element of claim 2, wherein said apertures are hexagonal.

8. The grid element of claim 1, wherein said apertures are rectangular and are arranged in parallel rows and parallel columns.

9. The grid element of claim 2, wherein said apertures are round.

10. The grid element of claim 2, wherein the size of said apertures varies across said body.

11. An ion optics set for use in an ion beam source comprising:

a screen grid that includes a body including a plurality of apertures passing therethrough, said body comprising a composite of carbon fibers and a carbon matrix; and an accelerator grid supported adjacent said screen grid, said accelerator grid including a body including a plurality of apertures passing therethrough, said body comprising a composite of carbon fibers and a carbon matrix, wherein said apertures in said screen grid and said accelerator grids are aligned.

12. The ion optics set of claim 11, further comprising:

a screen grid mount for attachment to said screen grid, comprising a composite of carbon fibers and a carbon matrix; and an accelerator grid mount for attachment to said accelerator grid, comprising a composite of carbon fibers and a carbon matrix, said screen grid mount and said accelerator grid mount supporting said screen grid and said accelerator grid in a spaced-apart alignment.

13. The ion optics set of claim 11, further comprising a decelerator grid that includes a body including a plurality of apertures passing therethrough, said body comprising a composite of carbon fibers and a carbon matrix.

14. An ion thruster comprising ion generation means for generating ions and the ion optics set of claim 11, included to emit ions generated by said ion generation means from said ion thruster.

15. An ion thruster comprising:

an ion plasma generator for producing a plasma;

an anode for collecting electrons from the plasma;

a power supply for drawing electrons collected by said anode to ground;

a neutralizer for ejecting electrons drawn to ground from said thruster;

a magnetic field source for inhibiting the flow of electrons and ions from the plasma in certain predetermined directions, a carbon-carbon screen grid having an array of apertures including a body comprising a composite of carbon fibers and a carbon matrix; and a carbon-carbon accelerator grid supported adjacent said screen grid, said accelerator grid including a body comprising a composite of carbon fibers and a carbon matrix having an array of apertures complementary to said apertures of said screen grid, said apertures of said screen grid and said apertures of said accelerator grid having centerlines that are aligned, said screen grid and said accelerator grid collectively extracting ions from the plasma and emitting them from said thruster, wherein said screen grid is maintained at a plasma potential and said apertures in said screen grid allow ions from said plasma to pass therethrough, and wherein said accelerator grid is maintained at a negative potential to accelerate such ions and emit them through said apertures in said accelerator grid.

16. The ion thruster of claim 15, further comprising:

a carbon-carbon screen grid mount and a carbon-carbon accelerator grid mount for supporting said screen grid and said accelerator grid in a predetermined alignment.

17. The ion thruster of claim 15, further comprising a carbon-carbon decelerator grid having an array of apertures and spaced in a predetermined alignment relative to said accelerator grid.

18. The grid element of claim 1 wherein the thickness is between about 0.4–0.8 mm.

19. The grid element of claim 1 wherein the open area fraction is between about 0.29–0.59.

20. A carbon-carbon grid element for an ion optic set in an ion thruster, comprising:

a carbon-carbon body of substantially uniform thickness including a carbon fiber array infiltrated with a carbonaceous material to provide a peripheral mounting flange and a central ion accelerating grid, the grid comprising a regular spaced array of apertures of substantially uniform shape and area.

21. The grid element of claim 20 wherein each aperture is uniformly tapered across the thickness of the body.

22. The grid element of claim 20 wherein the body is substantially planar.

23. The grid element of claim 20 wherein the body is slightly curved away from planar to add stiffness.

24. A grid element, for use in an ion optic set for an ion beam source, comprising: a substantially planar body of substantially uniform thickness and adapted for use in the ion optic set and including a regular spaced array of apertures of substantially uniform shape and area, passing therethrough, said body comprising a carbon-carbon composite of carbon fibers and a carbon matrix, the carbon fibers extending continuously from one edge of the grid element to an opposite edge of the grid element, the areas of said body and said apertures being related by a predetermined open area fraction, the composite having a coefficient of thermal expansion substantially equal to zero.

25. The grid element of claim 24, wherein said carbon fibers have an elastic modulus ranging above about $4\times10^5$ MPa.

26. The grid element of claim 25, wherein said elastic modulus range is between about $7\times10^5$ MPa to about $1\times10^6$ MPa.

27. The grid element of claim 24, wherein said carbon fibers are oriented parallel to a first axis, parallel to a second axis offset from the first axis by about 60°, and parallel to a third axis offset from the first axis and the second axis by about 60°.

28. The grid element of claim 24, wherein the apertures have a tapered profile.

29. The grid element of claim 24, wherein said apertures are hexagonal.

30. The grid element of claim 24, wherein said apertures are rectangular and are arranged in parallel rows and parallel columns.

31. The grid element of claim 24, wherein said apertures are round.

32. The grid element of claim 24, wherein the size of said apertures varies across said body.

* * * * *

UNITED STATES PATENT AND TRADEMARK OFFICE

CERTIFICATE OF CORRECTION

PATENT NO. : 5,448,883

DATED : September 12, 1995

INVENTOR(S) : J.S. Meserole, Jr. et al.

It is certified that error appears in the above-indentified patent and that said Letters Patent is hereby corrected as shown below:

| COLUMN | LINE | |
|---|---|---|
| 1 | 17 | "tile" should read --the-- |
| 1 | 50 | "plasma Ions" should read --plasma. Ions-- |
| 11 | 7 | "1.58 min." should read --1.58 mm.-- |
| 12 | 27 | "fiat" should read --flat-- |

Signed and Sealed this

Nineteenth Day of December, 1995

Bruce Lehman

*Attest:*

BRUCE LEHMAN

*Attesting Officer*

*Commissioner of Patents and Trademarks*